US009814636B1

(12) United States Patent
Person, Jr.

(10) Patent No.: US 9,814,636 B1
(45) Date of Patent: Nov. 14, 2017

(54) LATERAL MOVEMENT WHEELCHAIR

(71) Applicant: Orville Person, Jr., Fort Worth, TX (US)

(72) Inventor: Orville Person, Jr., Fort Worth, TX (US)

( * ) Notice: Subject to any disclaimer, the term of this patent is extended or adjusted under 35 U.S.C. 154(b) by 0 days.

(21) Appl. No.: 15/175,115

(22) Filed: Jun. 7, 2016

(51) Int. Cl.
*A61G 5/10* (2006.01)

(52) U.S. Cl.
CPC ..... *A61G 5/10* (2013.01)

(58) Field of Classification Search
CPC ..... A61G 5/10; A61G 5/1051; A61G 5/1083; A61G 5/1089; A61G 5/027; B62B 2301/02
See application file for complete search history.

(56) References Cited

U.S. PATENT DOCUMENTS 2,675,057 A 4/1954 Glass
D273,376 S 4/1984 Charles
5,613,697 A * 3/1997 Johnson ..... A61G 5/02 280/250.1
5,667,230 A * 9/1997 Riley ..... B62B 5/0083 280/35
5,743,545 A 4/1998 Kunze
5,762,154 A * 6/1998 Hsu ..... A61G 5/047 180/15
6,155,583 A * 12/2000 Koike ..... A61G 5/10 280/250.1
6,419,260 B1 7/2002 Kuroda
6,478,099 B1 11/2002 Madwed
6,530,598 B1 * 3/2003 Kirby ..... A61G 5/10 280/647
7,281,724 B1 * 10/2007 Larson ..... A61G 5/00 280/250.1
7,819,415 B2 * 10/2010 Kio ..... A61G 5/045 280/250.1
2006/0097478 A1 * 5/2006 Goertzen ..... A61G 5/02 280/304.1
2007/0222199 A1 * 9/2007 Schattner ..... A61G 5/1089 280/755
2008/0014052 A1 * 1/2008 Rodriguez ..... B66F 9/07568 414/11
2008/0067780 A1 * 3/2008 Dror ..... A61G 5/10 280/304.1
2008/0106060 A1 * 5/2008 Knopf ..... A61G 5/02 280/250.1
2008/0197598 A1 * 8/2008 Mills ..... A61G 5/1051 280/250.1
2012/0235394 A1 * 9/2012 Moreno Vallejo ..... B62B 3/001 280/761
2015/0008051 A1 * 1/2015 Halsall ..... A61G 5/043 180/6.6

(Continued)

*Primary Examiner* — Katy M Ebner
(74) *Attorney, Agent, or Firm* — Kyle A. Fletcher, Esq.

(57) ABSTRACT

The lateral movement wheelchair is a device adapted for use with wheelchairs. The lateral movement wheelchair is a spring loaded device that is attached to the tipping levers of a wheelchair. When the lateral movement wheelchair is lowered to the ground, the wheelchair can be tipped back allowing a first wheel and a second wheel to move the wheelchair laterally for the purpose of positioning the wheelchair precisely for loading and unloading (for example a passenger vehicle). The lateral movement wheelchair comprises a frame, a first wheel, and a second wheel.

13 Claims, 5 Drawing Sheets

(56) References Cited

U.S. PATENT DOCUMENTS

| | | | | |
|---|---|---|---|---|
| 2015/0196440 | A1* | 7/2015 | Pirone | A61G 5/1051 280/657 |
| 2016/0022513 | A1* | 1/2016 | Spoor | B62B 9/082 296/20 |

* cited by examiner

LATERAL MOVEMENT WHEELCHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical transport for patients, more specifically, a wheelchair capable of lateral movement.

SUMMARY OF INVENTION

The lateral movement wheelchair is a device adapted for use with wheelchairs. The lateral movement wheelchair is a spring loaded device that is attached to the tipping levers of a wheelchair. When the lateral movement wheelchair is lowered to the ground, the wheelchair can be tipped back allowing a first wheel and a second wheel to move the wheelchair laterally for the purpose of positioning the wheelchair precisely for loading and unloading (for example a passenger vehicle).

These together with additional objects, features and advantages of the lateral movement wheelchair will be readily apparent to those of ordinary skill in the art upon reading the following detailed description of the presently preferred, but nonetheless illustrative, embodiments when taken in conjunction with the accompanying drawings.

In this respect, before explaining the current embodiments of the lateral movement wheelchair in detail, it is to be understood that the lateral movement wheelchair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the lateral movement wheelchair.

It is therefore important that the claims be regarded as including such equivalent construction insofar as they do not depart from the spirit and scope of the lateral movement wheelchair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
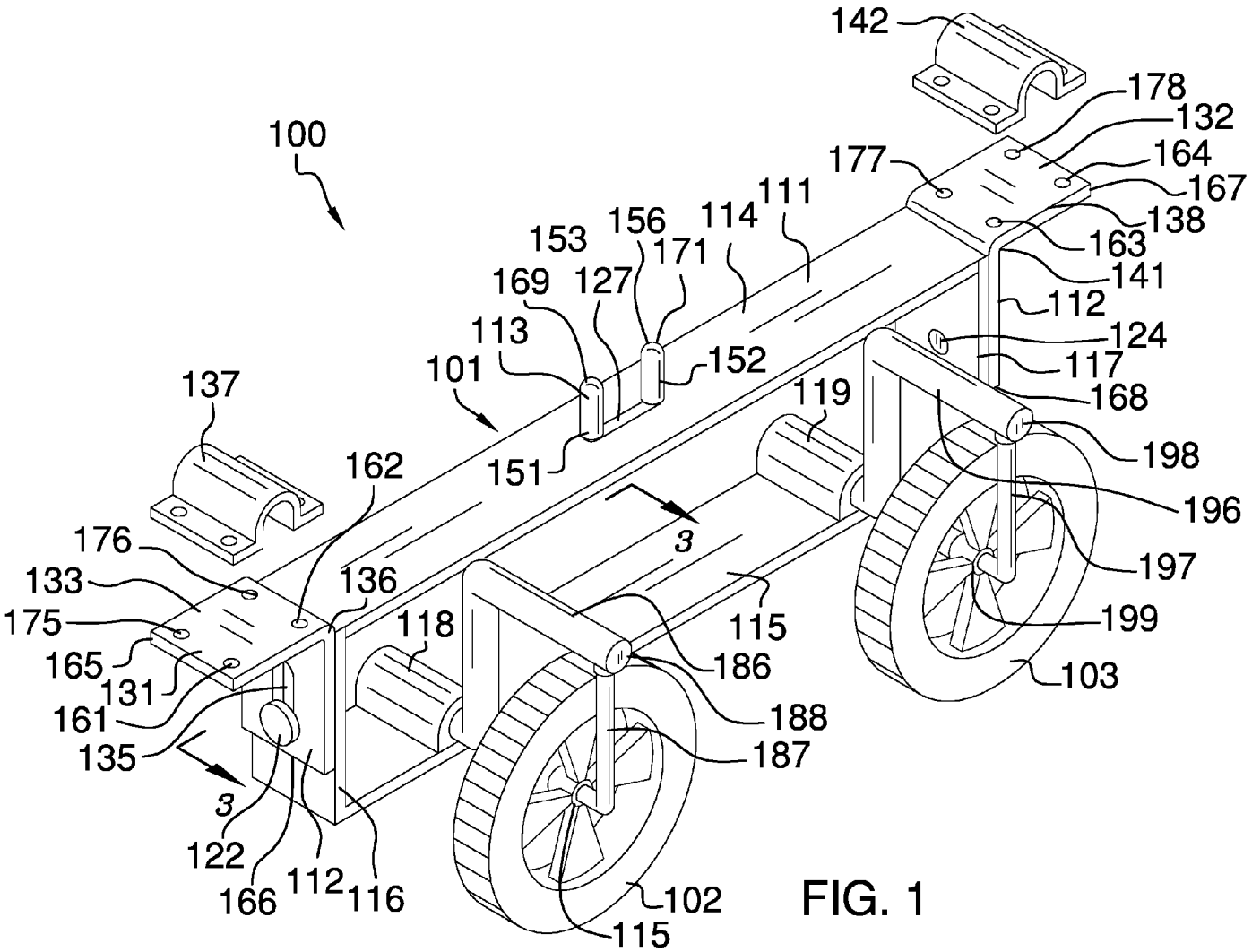
FIG. 1 is a perspective view of an embodiment of the disclosure.
Figure 2A:
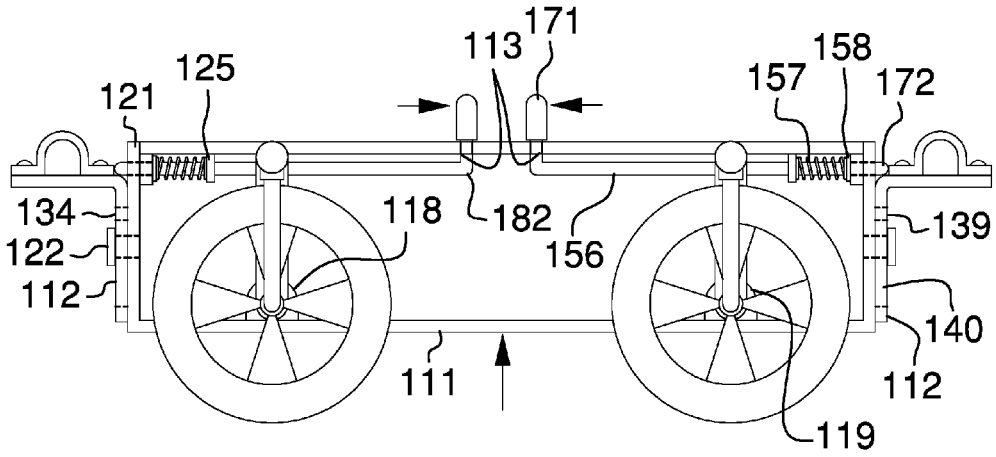
FIG. 2A is a first, rear view of an embodiment of the disclosure.
Figure 2B:
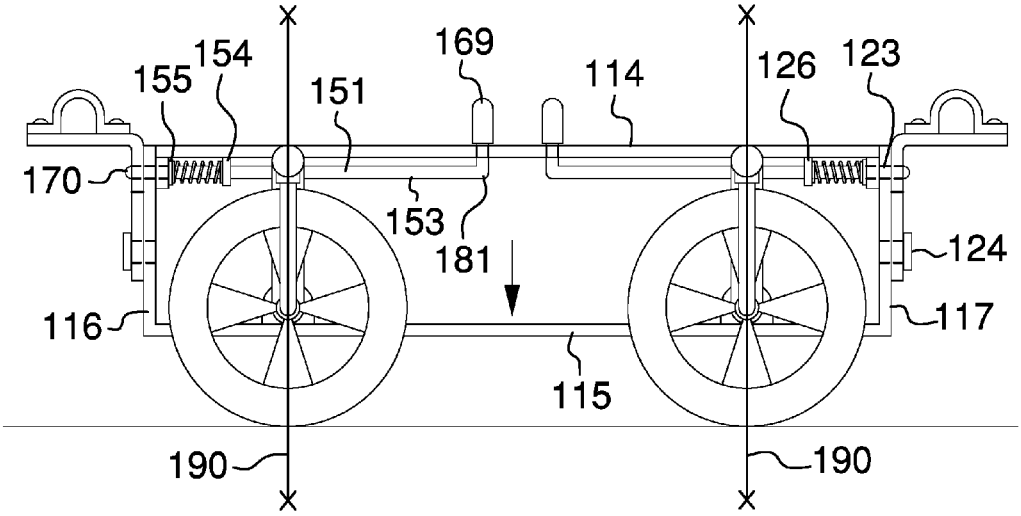
FIG. 2B is a second, rear view of an embodiment of the disclosure.
Figure 3:
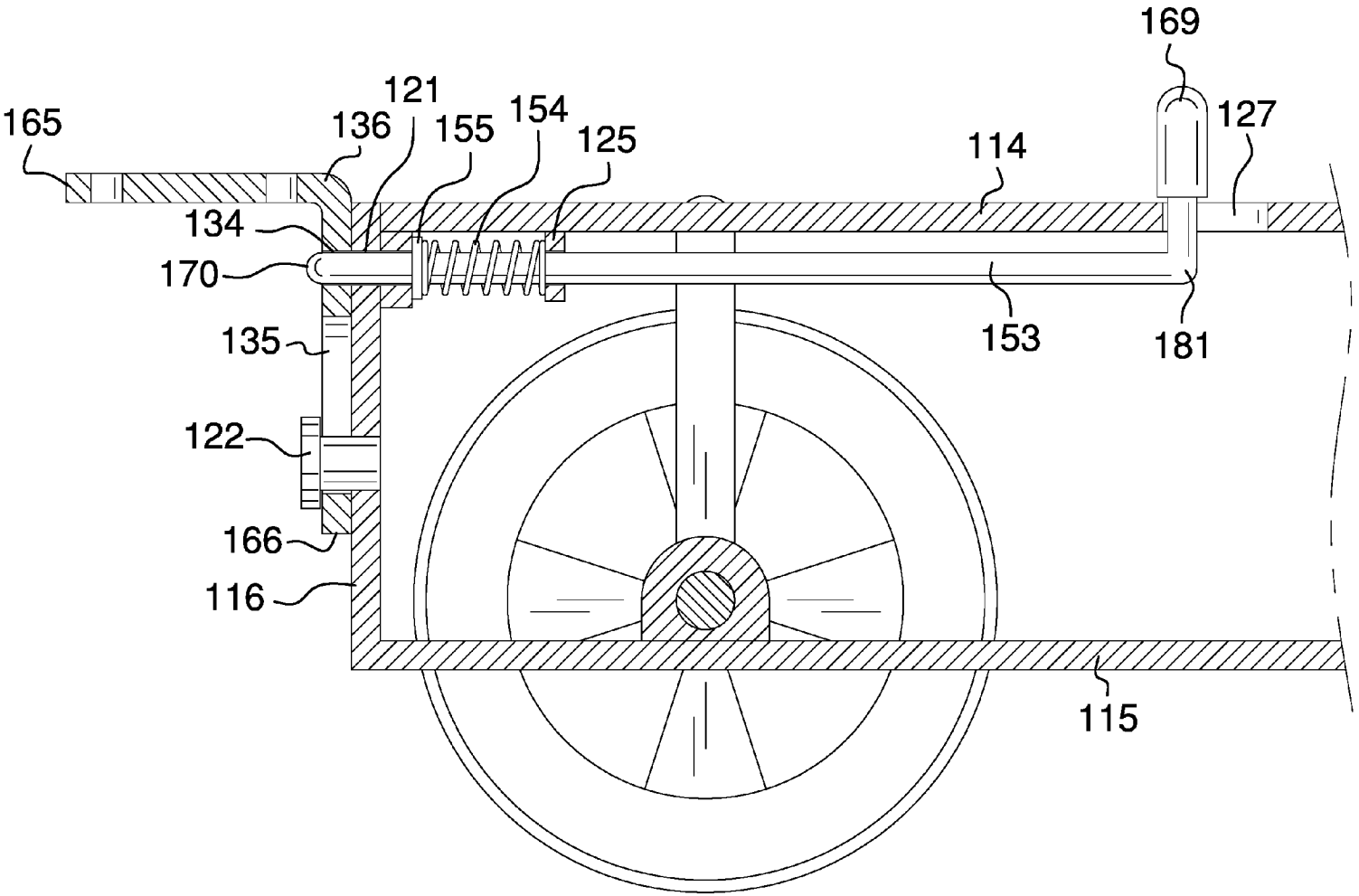
FIG. 3 is a cross-sectional view of an embodiment of the disclosure across 3-3 in FIG. 1.
Figure 4:
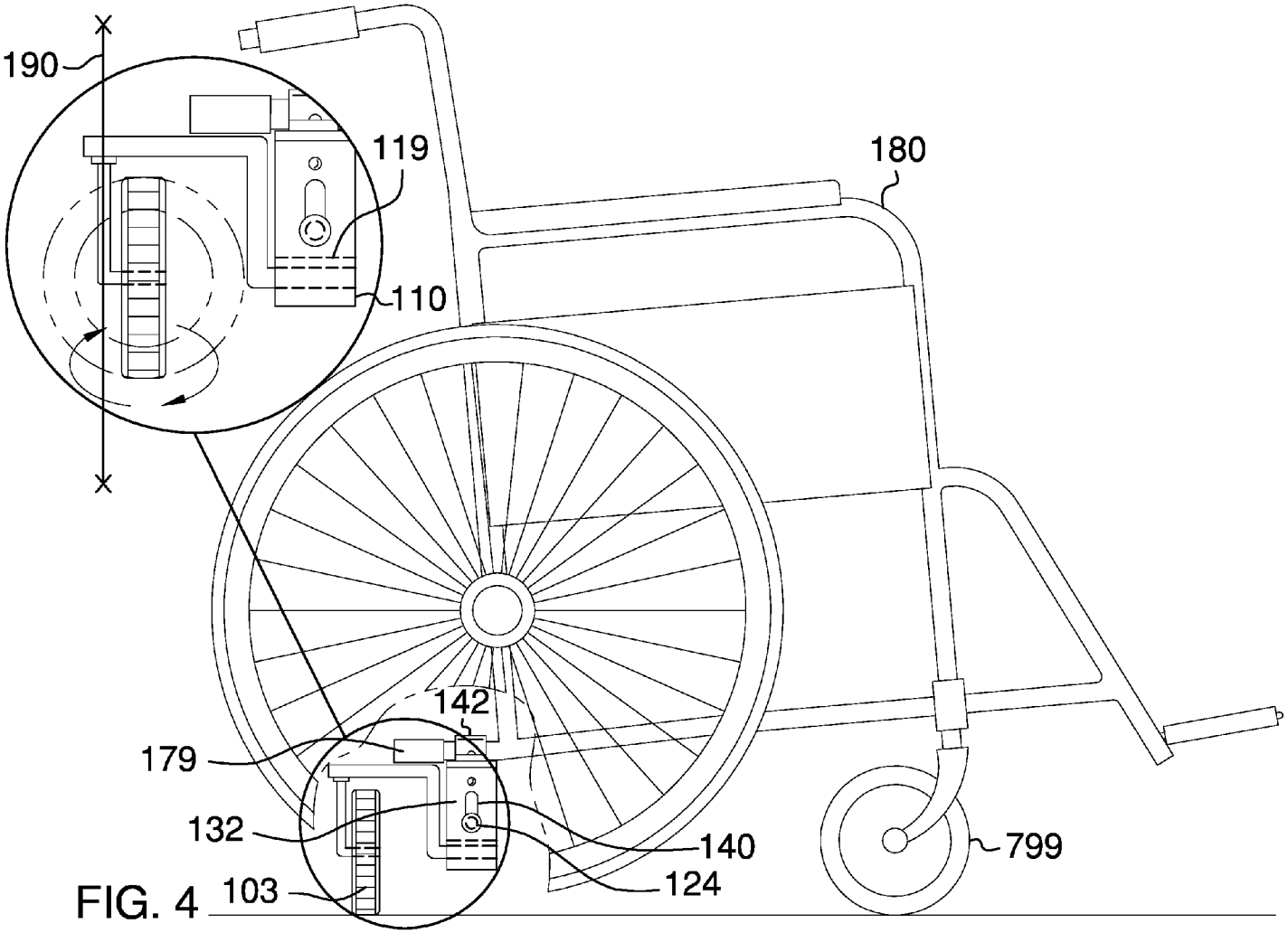
FIG. 4 is an in use view of an embodiment of the disclosure.
Figure 5:
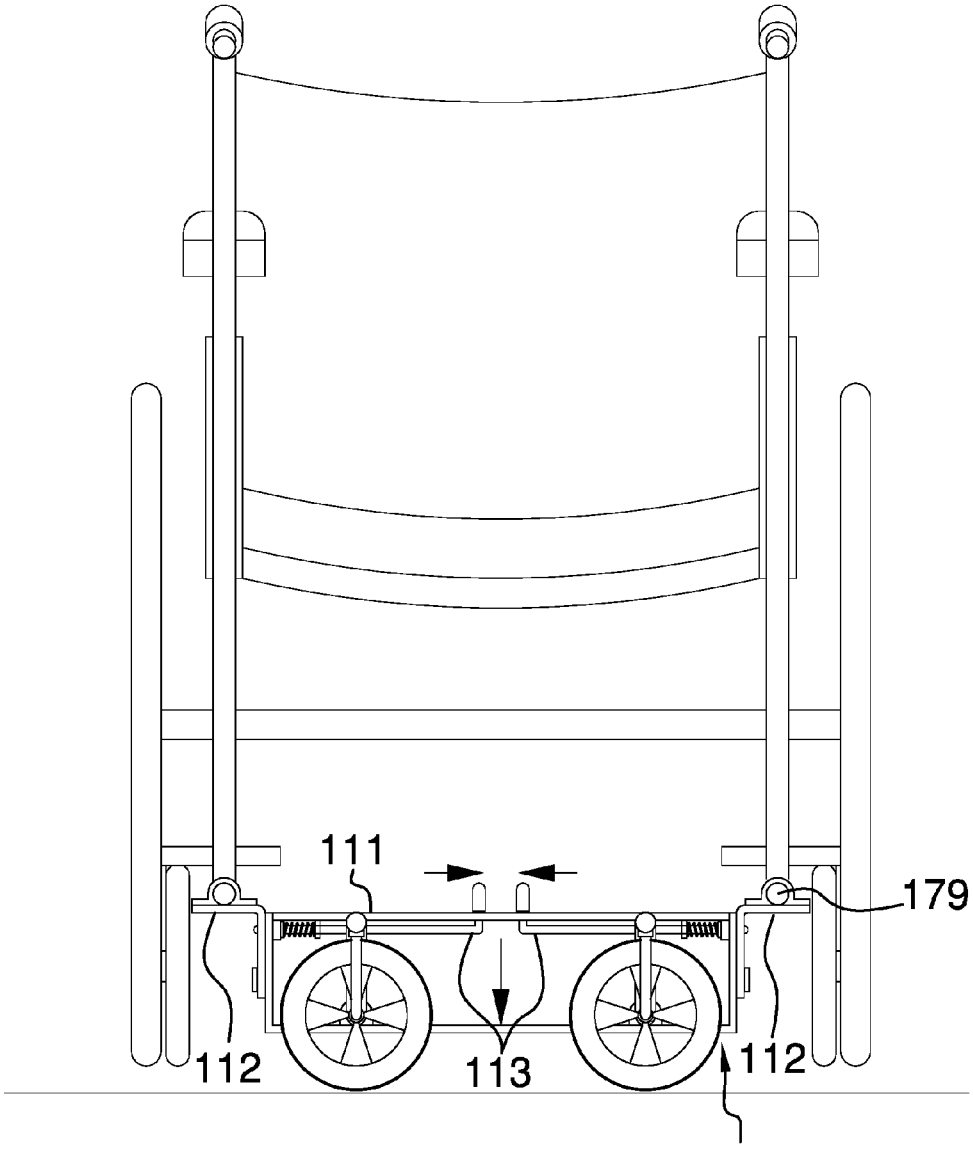
FIG. 5 is an in use view of an embodiment of the disclosure.

Detailed reference will now be made to a first potential embodiment of the disclosure, which is illustrated in FIGS. 1 through 5.

The lateral movement wheelchair 100 (hereinafter invention) comprises a frame 101, a first wheel 102, and a second wheel 103. The invention 100 is a device adapted for use with a wheelchair 180. The invention 100 is a spring loaded device that is attached to the tipping levers 179 of a wheelchair 180. When the invention 100 is lowered to the ground, the wheelchair 180 can be tipped back allowing the first wheel 102 and the second wheel 103 to move the wheelchair 180 in any direction for the purpose of positioning the wheelchair 180 precisely for loading and unloading (for example a passenger vehicle).

The frame 101 further comprises a primary structure 111, a suspension 112, and a latch structure 113.

The primary structure 111 is the support structure that is designed to bear the primary load of the wheelchair 180 when the invention 100 is in use. The first wheel 102 and the second wheel 103 are attached to the primary structure 111. The primary structure 111 further comprises an upper joist 114, a lower joist 115, a first arm 116, a second arm 117, a first bearing 118, and a second bearing 119. As shown most clearly in FIGS. 2 and 3, the upper joist 114, the lower joist 115, the first arm 116 and the second arm 117 are joined together to form a rectangular structure. The first bearing 118 and the second bearing 119 are mounted on the lower joist 115. The first bearing 118 attaches the first wheel 102 to the primary structure 111 such that the first wheel 102 rotates freely in any direction perpendicular of motion of a wheelchair 180.

The second bearing 119 attaches the second wheel 103 to the primary structure 111 such that the second wheel 103 rotates freely in any direction of motion of the wheelchair 180 and in the same direction independent of the first wheel 102. The first arm 116 further comprises a first locking hole 121 and a first guide bolt 122. The first locking hole 121 is a hole that is sized to receive a shaft that will lock the first arm 116 into position. The first guide bolt 122 is a shaft that is attached to the first arm 116 and projects perpendicularly away from the first arm 116. The use of the first locking hole 121 and the first guide bolt 122 are discussed in detail elsewhere in this disclosure. The second arm 117 further comprises a second locking hole 123 and a second guide bolt 124. The second locking hole 123 is a hole that is sized to receive a shaft that will lock the second arm 117 into position. The second guide bolt 124 is a shaft that is attached to the second arm 117 and projects perpendicularly away from the second arm 117. The use of the second locking hole 123 and the second guide bolt 124 are discussed in detail elsewhere in this disclosure.

The upper joist 114 further comprises a first plate 125, a second plate 126, and a latch slot 127. The latch slot 127 is a long and relatively narrow aperture that is formed in the upper joist 114. The first plate 125 is a strip of metal that projects perpendicularly away from the upper joist 114. The first plate 125 has a hole formed in it. The second plate 126 is a strip of metal that projects perpendicularly away from the upper joist 114. The second plate 126 has a hole formed in it. The first plate 125 and the second plate 126 are discussed in detail elsewhere in this disclosure.

The suspension 112 attaches the primary structure 111 to the wheelchair 180, lowers the primary structure 111 into position when the invention 100 is in use and raises the primary structure 111 into a storage position when the invention 100 is not in use. The suspension 112 further comprises a first clamp 131 and a second clamp 132.

The first clamp 131 further comprises a first flat iron 133, a first latch hole 134, a first slot 135, a first angle 136 and a first U clamp 137. The first clamp 131 further comprises a first bolt hole 161, a second bolt hole 162, a fifth bolt hole 175 and a sixth bolt hole 176. The first flat iron 133 is a readily and commercially available flat metal bar that is attached to first arm 116 of the primary structure 111. The first flat iron 133 further comprises a first end 165 and a second end 166. The second end 166 of the first flat iron 133 is positioned such that the second end 166 of the first flat iron 133 is proximal to the surface the wheelchair 180 is resting upon when the wheelchair 180 is used normally. The first angle 136 is a right angle bend that is formed in the first flat iron 133. The first latch hole 134 is a hole that is formed in the first flat iron 133 between first angle 136 and the second end 166 of the first flat iron 133.

The first slot 135 is a long and relatively narrow aperture that is formed in the first flat iron 133 between first angle 136 and the second end 166 of the first flat iron 133. The first slot 135 is sized to receive the first guide bolt 122. The first bolt hole 161, the second bolt hole 162, the fifth bolt hole 175 and the sixth bolt hole 176 are holes that are formed in the first flat iron 133 between the first angle 136 and the first end 165 of the first flat iron 133. The first U clamp 137 is a commercially available U bolt that is sized to fit into the first bolt hole 16 the second bolt hole 162, the fifth bolt hole 175 and the sixth bolt hole 176.

The second clamp 132 further comprises a second flat iron 138, a second latch hole 139, a second slot 140, a second angle 141, and a second U clamp 142. The second clamp 132 further comprise a third bolt hole 163, a fourth bolt hole 164, a seventh bolt hole 177, and an eighth bolt hole 178. The second flat iron 138 is a readily and commercially available flat metal bar that is attached to second arm 117 of the primary structure 111. The second flat iron 138 further comprises a third end 167 and a fourth end 168. The fourth end 168 of the second flat iron 138 is positioned such that the fourth end 168 of the second flat iron 138 is proximal to the surface the wheelchair 180 is resting upon when the wheelchair 180 is used normally.

The second angle 141 is a right angle bend that is formed in the second flat iron 138. The second latch hole 139 is a hole that is formed in the second flat iron 138 between second angle 141 and the fourth end 168 of the second flat iron 138. The second slot 140 is a long and relatively narrow aperture that is formed in the second flat iron 138 between second angle 141 and the fourth end 168 of the second flat iron 138. The second slot 140 is sized to receive the second guide bolt 124. The second bolt hole 163 the fourth bolt hole 164, the seventh bolt hole 177, and the eighth bolt hole 178 are holes that are formed in the second flat iron 138 between the second angle 141 and the third end 167 of the second flat iron 138. The second U clamp 142 is a commercially available U bolt that is sized to fit into the third bolt hole 163 the fourth bolt hole 164, the seventh bolt hole 177, and the eighth bolt hole 178.

The latch structure 113 locks the primary structure 111 into position after the primary structure 111 has been moved into the usage position or after the primary structure 111 has been moved into the storage position. The latch structure 113 comprises a first latch 151 and a second latch 152. The first latch 151 further comprises a first latch bar 153, a first latch spring 154 and a first latch washer 155. The first latch bar 153 is a cylindrical rod that further defined with a fifth end 169 and a sixth end 170. The first latch bar 153 is further formed with a third angle 181. The third angle 181 is a right angle. The diameter of the first latch bar 153 is such that the first latch bar 153 will fit through the latch slot 127, the first latch hole 134, the first locking hole 121 and the hole formed in the first plate 125.

The first latch spring 154 is a helical coil compression spring that fits around the sixth end 170 of the first latch bar 153. The first latch washer 155 fits around the second end 166 such that the first latch spring 154 between the third angle 181 and the first latch washer 155. The second latch 152 further comprises a second latch bar 156, a second latch spring 157 and a second latch washer 158. The second latch bar 156 is a cylindrical rod that further defined with a seventh end 171 and an eighth end 172. The second latch bar 156 is further formed with a fourth angle 182. The fourth angle 182 is a right angle. The diameter of the second latch bar 156 is such that the second latch bar 156 will fit through the latch slot 127, the second latch hole 139, the second locking hole 123 and the hole formed in the second plate 126. The second latch spring 157 is a helical coil compression spring that fits around the eighth end 172 of the second latch bar 156. The second latch washer 158 fits around the fourth end 168 such that the second latch spring 157 is between the fourth angle 182 and the second latch washer 158.

The invention 100 is assembled as follows. The first clamp 131 is attached to the first arm 116 such that: 1) the first locking hole 121 is aligned with the first latch hole 134; 2) the first guide bolt 122 is inserted through the first slot 135 to attach the first clamp 131 to the first arm 116 such that the first head 128 of the first guide bolt 122 prevents the first clamp 131 from coming off the first guide bolt 122; and, 3)

the first angle 136 is positioned such that the first end 165 of the first flat iron 133 projects away from the first arm 116.

The second clamp 132 is attached to the second arm 117 such that: 1) the second locking hole 123 is aligned with the second latch hole 139; 2) the second guide bolt 124 is inserted through the second slot 140 to attach the second clamp 132 to the second arm 117 such that the second head 129 of the second guide bolt 124 prevents the second clamp 132 from coming off the second guide bolt 124; and, 3) the second angle 141 is positioned such that the third end 167 of the second flat iron 138 projects away from the second arm 117. The fifth end 169 of the first latch bar 153 is inserted through the latch slot 127. The sixth end 170 of the first latch bar 153 is inserted through the hole of the first plate 125. The first latch spring 154 and the first latch washer 155 are placed over the sixth end 170 of the first latch bar 153 and the sixth end 170 of the first latch bar 153 is inserted through the first locking hole 121 and the first latch hole 134. The seventh end 171 of the second latch bar 156 is inserted through the latch slot 127. The eighth end 172 of the second latch bar 156 is inserted through the hole of the second plate 126. The second latch spring 157 and the second latch washer 158 are placed over the eighth end 172 of the second latch bar 156 and the eighth end 172 of the second latch bar 156 is inserted through the second locking hole 123 and the second latch hole 139.

The method of operation is as follows. To install the invention 100 on a wheelchair 180, the first U clamp 137 is used to attach the section of the first flat iron 133 from the first end 165 to the first angle 136 to a first tipping lever 179 of the wheelchair 180. The second U clamp 142 is used to attach the section of the second flat iron 138 from the third end 167 to the second angle 141 a second tipping lever 179 of the wheelchair 180. As shown most clearly in FIG. 2, in the resting position the sixth end 170 of the first latch bar 153 is inserted through the first locking hole 121 such that the first latch bar 153 rests upon the portion of the first flat iron 133 between the first angle 136 and the first end 165. As also shown most clearly in FIG. 2, in the resting position eighth end 172 of the second latch bar 156 is inserted through the second locking hole 123 such that the second latch bar 156 rests upon the portion of the second flat iron 138 between the second angle 141 and the third end 167.

To move the primary structure 111 of the frame 101 into position for use of the invention 100, the sixth end 170 of the first latch bar 153 and the eighth end 172 of the second latch bar 156 are pulled toward the first plate 125 and the second plate 126. The primary structure 111 is then lowered which brings the first wheel 102 and the second wheel 103 to the surface the wheelchair 180 is resting upon. At this point, which is the usage position and is shown most clearly in FIG. 3, the sixth end 170 of the first latch bar 153 is inserted through both the first locking hole 121 and the first latch hole 134. The eighth end 172 of the second latch bar 156 is inserted through both the second locking hole 123 and the second latch hole 139. To move the wheelchair 180, the weight of the wheelchair 180 is resting on the first wheel 102 and the second wheel 103 as well as front wheels 799 of the wheelchair 180. The first wheel 102, the second wheel 103, and the front wheels 799 of the wheelchair 180 provide mobility to rotate and move the wheelchair in any direction.

The first wheel 102 is attached to the first bearing 118 via a first bracket 186. The first bracket 186 extends over the first wheel 102. A first armature 187 extends down from a first distal end 188 of the first bracket 186. The first armature 187 extends to a first hub 189 of the first wheel 102. The first armature 187 enables 360 degree rotational movement of the first wheel 102 along a first vertical axis 190 (see FIGS. 2*b* and 4).

The second wheel 103 is attached to the second bearing 119 via a second bracket 196. The second bracket 196 extends over the second wheel 103. A second armature 197 extends down from a second distal end 198 of the second bracket 196. The second armature 197 extends to a second hub 199 of the second wheel 103. The second armature 197 enables 360 degree rotational movement of the second wheel 103 along a second vertical axis 200 (see FIG. 2*b*).

In the first potential embodiment of the disclosure, the structural components of the frame 101 are formed from commercially available steel. The remaining components of the frame 101 are commercially available hardware. The first wheel 102 and the second wheel 103 are commercially available. All attachments of the structural components of the frame 101 are welded.

The following definitions were used in this disclosure:

Strip: As used in this disclosure, the term describes a long thin object of uniform width. Strips are often rectangular blocks in shape.

Tipping Lever: As used in this disclosure, a tipping lever is a rod of a wheelchair that extends from underneath the wheelchair in the direction behind the patient. Using the wheels of the wheelchair as a pivot point, the tipping lever acts as a lever that makes it easier to move the wheelchair over obstacles such as curbs. A wheelchair is typically outfitted with two tipping levers so that either foot can be used.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An apparatus comprising:

a frame, a first wheel, and a second wheel;

wherein the apparatus is adapted for use with a wheelchair;

wherein the apparatus is a spring loaded device;

wherein the apparatus is adapted to be attached to the tipping levers of a wheelchair;

wherein when the apparatus is lowered to the ground, the wheelchair can be moved and rotated in any direction by allowing the first wheel and the second wheel as well as front wheels of the wheelchair to move in any direction;

wherein the frame further comprises a primary structure, a suspension, and a latch structure;

wherein the first wheel and the second wheel are attached to the primary structure;

wherein the primary structure further comprises an upper joist, a lower joist, a first arm, a second arm, a first bearing, and a second bearing;

wherein the upper joist, the lower joist, the first arm and the second arm are joined together to form a rectangular structure;

wherein the first bearing and the second bearing are mounted on the lower joist;

wherein the first bearing attaches the first wheel to the primary structure such that the first wheel rotates freely in any direction of motion of the wheelchair;

wherein the second bearing attaches the second wheel to the primary structure such that the second wheel rotates freely in any direction of motion of the wheelchair;

wherein the first arm further comprises a first locking hole and a first guide bolt;

wherein the second arm further comprises a second locking hole and a second guide bolt.

2. The apparatus according to claim 1 wherein the first locking hole is a hole that is sized to receive a shaft that will lock the first arm into position;

wherein the first guide bolt is a shaft that is attached to the first arm and projects perpendicularly away from the first arm;

wherein the second locking hole is a hole that is sized to receive a shaft that will lock the second arm into position;

wherein the second guide bolt is a shaft that is attached to the second arm and projects perpendicularly away from the second arm.

3. The apparatus according to claim 2 wherein the upper joist further comprises a first plate, a second plate, and a latch slot;

wherein the first plate is a strip of metal that projects perpendicularly away from the upper joist;

wherein the first plate has a hole formed in it;

wherein the second plate is a strip of metal that projects perpendicularly away from the upper joist;

wherein the second plate has a hole formed in it.

4. The apparatus according to claim 3 wherein the suspension further comprises a first clamp and a second clamp.

5. The apparatus according to claim 4 wherein the first clamp further comprises a first flat iron, a first latch hole, a first slot, a first angle and a first U clamp;

wherein the second clamp further comprises a second flat iron, a second latch hole, a second slot, a second angle, and a second U clamp;

wherein the first flat iron is attached to the first arm;

wherein the second flat iron is attached to the second arm;

wherein the first flat iron further comprises a first end and a second end;

wherein the second flat iron further comprises a third end and a fourth end.

6. The apparatus according to claim 5 wherein the first angle is a right angle bend that is formed in the first flat iron;

wherein the first latch hole is a hole that is formed in the first flat iron between first angle and the second end of the first flat iron;

wherein the second angle is a right angle bend that is formed in the second flat iron;

wherein the second latch hole is a hole that is formed in the second flat iron between second angle and the fourth end of the second flat iron.

7. The apparatus according to claim 6 wherein the first slot is an aperture that is formed in the first flat iron between first angle and the second end of the first flat iron;

wherein the first slot is sized to receive the first guide bolt;

wherein the second slot is an aperture that is formed in the second flat iron between second angle and the fourth end of the second flat iron;

wherein the second slot is sized to receive the second guide bolt.

8. The apparatus according to claim 7 wherein the first clamp is attached to a first tipping lever of the wheelchair with the first U clamp;

wherein the second clamp is attached to a first tipping lever of the wheelchair with the second U clamp.

9. The apparatus according to claim 8 wherein the latch structure comprises a first latch and a second latch.

10. The apparatus according to claim 9 wherein the first latch further comprises a first latch bar, a first latch spring and a first latch washer;

wherein the second latch further comprises a second latch bar, a second latch spring and a second latch washer.

11. The apparatus according to claim 10 wherein the first latch bar is a cylindrical rod that further defined with a fifth end and a sixth end;

wherein the first latch bar is further formed with a third angle;

wherein the diameter of the first latch bar is such that the first latch bar will fit through the latch slot, the first latch hole, the first locking hole and the hole formed in the first plate;

wherein the first latch spring is a helical coil compression spring that fits around the sixth end of the first latch bar;

wherein the first latch washer fits around the second end such that the first latch spring between the third angle and the first latch washer;

wherein the second latch bar is a cylindrical rod that further defined with a seventh end and an eighth end;

wherein the second latch bar is further formed with a fourth angle;

wherein the diameter of the second latch bar is such that the second latch bar will fit through the latch slot, the second latch hole, the second locking hole and the hole formed in the second plate;

wherein the second latch spring is a helical coil compression spring that fits around the eighth end of the second latch bar;

wherein the second latch washer fits around the fourth end such that the second latch spring is between the fourth angle and the second latch washer.

12. The apparatus according to claim 11 wherein the first clamp is attached to the first arm such that the first locking hole is aligned with the first latch hole;

wherein the first clamp is attached to the first arm such that the first guide bolt is inserted through the first slot to attach the first clamp to the first arm such that the first head of the first guide bolt prevents the first clamp from coming off the first guide bolt;

wherein the first clamp is attached to the first arm such that the first angle is positioned such that the first end of the first flat iron projects away from the first arm;

wherein the second clamp is attached to the second arm such that the second locking hole is aligned with the second latch hole;

wherein the second clamp is attached to the second arm such that the second guide bolt is inserted through the second slot to attach the second clamp to the second arm such that the second head of the second guide bolt prevents the second clamp from coming off the second guide bolt;

wherein the second clamp is attached to the second arm such that the second angle is positioned such that the third end of the second flat iron projects away from the second arm;

wherein the fifth end of the first latch bar is inserted through the latch slot;

wherein the sixth end of the first latch bar is inserted through the hole of the first plate;

wherein the first latch spring and the first latch washer are placed over the sixth end of the first latch bar and the sixth end of the first latch bar is inserted through the first locking and the first latch hole;

wherein the seventh end of the second latch bar is inserted through the latch slot;

wherein the eighth end of the second latch bar is inserted through the hole of the second plate;

wherein the second latch spring and the second latch washer are placed over the eighth end of the second latch bar and the eighth end of the second latch bar is inserted through the second locking hole and the second latch hole.

13. The apparatus according to claim 12 wherein the first wheel is attached to the first bearing via a first bracket; wherein the first bracket extends over the first wheel; wherein a first armature extends down from a first distal end of the first bracket; wherein the first armature extends to a first hub of the first wheel; wherein the first armature enables 360 degree rotational movement of the first wheel along a first vertical axis; wherein the second wheel is attached to the second bearing via a second bracket; wherein the second bracket extends over the second wheel; wherein a second armature extends down from a second distal end of the second bracket; wherein the second armature extends to a second hub of the second wheel; wherein the second armature enables 360 degree rotational movement of the second wheel along a second vertical axis.

* * * * *